US009907448B2

(12) United States Patent
Waller et al.

(10) Patent No.: US 9,907,448 B2
(45) Date of Patent: Mar. 6, 2018

(54) DIRT PICK-UP DEVICE AND FLOOR CLEANER WITH A DIRT PICK-UP DEVICE

(71) Applicant: Alfred Kärcher GmbH & Co. KG, Winnenden (DE)

(72) Inventors: Christoph Waller, Schwaikheim (DE); Joerg Brueckner, Gerlingen (DE)

(73) Assignee: Alfred Kärcher GmbH & Co., KG, Winnenden (DE)

( * ) Notice: Subject to any disclaimer, the term of this patent is extended or adjusted under 35 U.S.C. 154(b) by 0 days.

(21) Appl. No.: 15/386,058

(22) Filed: Dec. 21, 2016

(65) Prior Publication Data

US 2017/0100011 A1 Apr. 13, 2017

Related U.S. Application Data

(63) Continuation of application No. PCT/EP2014/063870, filed on Jun. 30, 2014.

(51) Int. Cl.
*A47L 11/30* (2006.01)
*A47L 11/40* (2006.01)

(52) U.S. Cl.
CPC ..... *A47L 11/4044* (2013.01); *A47L 11/305* (2013.01)

(58) Field of Classification Search
CPC ..... A47L 11/4044; A47L 11/305; A47L 11/30
USPC ..... 15/320, 401
See application file for complete search history.

(56) References Cited

U.S. PATENT DOCUMENTS 5,377,382 A 1/1995 Bores et al.

FOREIGN PATENT DOCUMENTS

| | | |
|---|---|---|
| AU | 2011 202 957 | 7/2011 |
| EP | 2 554 090 | 2/2013 |
| WO | WO 2011/057232 | 5/2011 |

*Primary Examiner* — David Redding
(74) *Attorney, Agent, or Firm* — Woble Bond Dickinson (US) LLP

(57) ABSTRACT

A dirt pick-up device for a floor cleaner is provided, including a carrying part fixable to the floor cleaner and a holding part releasably connectable to the carrying part with a suction strip held on the holding part, the carrying part and the holding part locked to each other by a locking device, the dirt pick-up device including an actuating element which is transferable from an unactuated position to an actuated position for transferring the locking device to an unlocked position in which the holding part is releasable from the carrying part. The dirt pick-up device can include or form a grip element held on at least one of the holding part and the suction strip, and in the unactuated position, the actuating element can be at a greater distance from the grip element than in the actuated position. A floor cleaner with a dirt pick-up device is also provided.

35 Claims, 6 Drawing Sheets

DIRT PICK-UP DEVICE AND FLOOR CLEANER WITH A DIRT PICK-UP DEVICE

CROSS-REFERENCE TO RELATED APPLICATIONS

This application is a continuation of international application number PCT/EP2014/063870 filed on Jun. 30, 2014, which is incorporated herein by reference in its entirety and for all purposes.

FIELD OF THE INVENTION

The present invention relates to a dirt pick-up device for a floor cleaner, comprising a carrying part fixed or fixable to the floor cleaner and a holding part releasably connectable to the carrying part with a suction strip held on the holding part, the carrying part and the holding part being locked to each other by a locking device assuming a locked position, the dirt pick-up device comprising an actuating element which is transferable from an unactuated position to an actuated position for transferring the locking device to an unlocked position in which the holding part is releasable from the carrying part.

The present invention also relates to a floor cleaner with a dirt pick-up device.

BACKGROUND OF THE INVENTION

A dirt pick-up device of the kind mentioned at the outset is used, in particular, in a floor cleaner in the form of a scrubbing-suction machine. The scrubbing-suction machine comprises a tank for a cleaning liquid, for example, water, which is applied to a floor surface to be cleaned. Dirt is detached from the floor surface with at least one cleaning unit of the scrubbing-suction machine (comprising, for example, a disk brush or a brush roller) and under the effect of the cleaning liquid. The mixture of dirt and cleaning liquid (dirty liquid) is picked up from the floor surface with the dirt pick-up device. For this purpose, the scrubbing-suction machine comprises a suction unit and a suction pipe, for example, a suction hose. The suction pipe is connected to a connection element of the dirt pick-up device, which opens into a suction channel formed by the suction strip. The dirty liquid is sucked off from the floor surface and, for example, transferred to a dirty liquid tank of the scrubbing-suction machine by subjecting the suction channel to negative pressure. During use of the dirt pick-up device in accordance with the specifications, the suction strip contacts the floor surface, and the floor cleaner moves in a cleaning direction which usually coincides with the longitudinal direction of the floor cleaner.

In the dirt pick-up device of the kind mentioned at the outset, a carrying part and a holding part are provided, which can be releasably connected to each other and releasably locked to each other by way of the locking device. This enables the suction strip to be exchanged, when required, for example, for maintenance, for adaptation of the dirt pick-up device to different floor surfaces or for performance of different cleaning tasks. For example, the suction strips may differ in their length and/or their curvature. With the actuating element, the locking device can be transferred from the locked position to an unlocked position, so that the holding part and the carrying part can be transferred from the connected state to a separated state, and the suction strip can be separated from the floor cleaner.

EP 2 554 090 A1 describes a floor cleaner with a generic dirt pick-up device.

An object underlying the present invention is to provide a dirt pick-up device of the kind mentioned at the outset and a floor cleaner, the handling of which is easier.

SUMMARY OF THE INVENTION

In a first aspect of the invention, a dirt pick-up device for a floor cleaner comprises a carrying part fixed or fixable to the floor cleaner and a holding part releasably connectable to the carrying part with a suction strip held on the holding part, the carrying part and the holding part being locked to each other by a locking device assuming a locked position. The dirt pick-up device comprises an actuating element which is transferable from an unactuated position to an actuated position for transferring the locking device to an unlocked position in which the holding part is releasable from the carrying part. The dirt pick-up device comprises or forms a grip element held on at least one of the holding part and the suction strip. In the unactuated position the actuating element is at a greater distance from the grip element than in the actuated position in which an operator is able to grasp the grip element.

In a second aspect of the invention, a floor cleaner comprises at least one dirt pick-up device in accordance with the first aspect.

BRIEF DESCRIPTION OF THE DRAWINGS

The foregoing summary and the following description may be better understood in conjunction with the drawing figures, of which.

DETAILED DESCRIPTION OF PREFERRED EMBODIMENTS OF THE INVENTION

Figure 1:
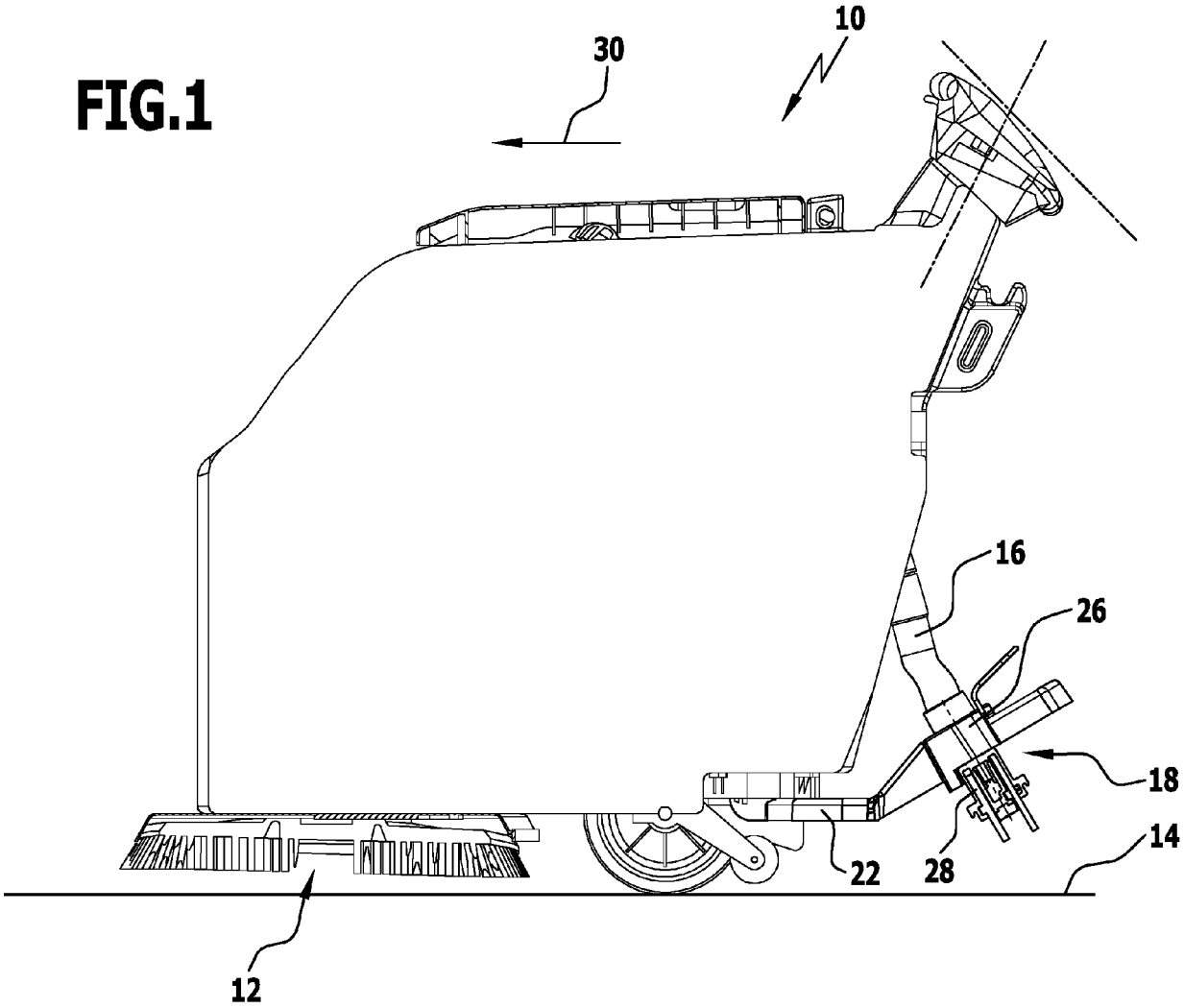
FIG. 1 shows a side view of a floor cleaner in accordance with the invention, configured as a scrubbing-suction machine, with a dirt pick-up device in accordance with the invention.

Although the invention is illustrated and described herein with reference to specific embodiments, the invention is not intended to be limited to the details shown. Rather, various modifications may be made in the details within the scope and range of equivalents of the claims and without departing from the invention.

The present invention relates to a dirt pick-up device for a floor cleaner, comprising a carrying part fixed or fixable to the floor cleaner and a holding part releasably connectable to the carrying part with a suction strip held on the holding part, the carrying part and the holding part being locked to each other by a locking device assuming a locked position, the dirt pick-up device comprising an actuating element which is transferable from an unactuated position to an actuated position for transferring the locking device to an unlocked position in which the holding part is releasable from the carrying part. The dirt pick-up device comprises or forms a grip element held on at least one of the holding part and the suction strip. In the unactuated position the actuating element is at a greater distance from the grip element than in the actuated position in which an operator is able to grasp the grip element.

The operator can act upon the actuating element of the dirt pick-up device in accordance with the invention with a force in order to transfer it from the unactuated position to the actuated position. The actuating element can thereby be moved to a shorter distance from the grip element. In the actuated position of the actuating element, the operator can grasp the grip element which is held on the holding part and/or on the suction strip. This allows the holding part with the suction strip held thereat to be released from the carrying part in a way which is easy to handle. With one movement of the operator, the locking device can be transferred to the unlocked position, and the grip element grasped in order to remove the suction strip. Ideally, one-hand operation is possible, with which the operator transfers the actuating element to the actuated position, thereby unlocks the locking device and grasps the grip element.

The grip element may be configured in different ways. For example, the grip element is configured as bow-shaped handle which is, for example, U-shaped, C-shaped or L-shaped. Alternatively, the grip element may be configured as handle bar, grip edge, olive handle, knob grip, grip eyelet or recessed grip.

The grip element is expediently formed in one piece with the holding part. It is preferably molded on the holding part and formed with it, for example, as one-piece plastic molded part.

The actuating element is preferably of bow-shaped configuration, for example, U-shaped, C-shaped or L-shaped.

It is advantageous for the actuating element to have a contour identical or similar to the contour of the grip element and in the actuated position to be positionable against the grip element. In the present case, this can be understood, in particular, as meaning that the actuating element has a contour adapted in such a way to the contour of the grip element that the actuating element, positioned against the grip element, does not protrude beyond its contour or is aligned or substantially aligned with an edge of the grip element. This improves the handling of the dirt pick-up device.

It proves advantageous for the grip element and/or the actuating element to define a reach-through area for an operator to reach through. For example, the grip element and/or the actuating element with U-shaped, C-shaped or L-shaped configuration define a reach-through area for the operator. The operator can reach through the reach-through area in order to grasp the actuating element and/or the grip element in such a way that the holding part can be released from the carrying part and removed.

In an operating position of the dirt pick-up device, the actuating element is preferably arranged above the grip element. Actuation of the actuating element from above reduces the risk of the actuating element being unintentionally actuated and the locking device unlocked. The latter could, for example, be brought about with an actuating element arranged below the grip element by articles on the floor surface or by a foot of the operator.

The actuating element is preferably pretensioned in the actuated position in the direction of the unactuated position. In the absence of the application of force to the actuating element by the operator, the actuating element automatically assumes the unactuated position again. For pretensioning the actuating element, the dirt pick-up device preferably comprises a pretensioning device, for example, in the form of the elastically deformable deformation element mentioned hereinbelow.

In an advantageous implementation of the dirt pick-up device, it proves expedient for the locking device, on the one hand, and the grip element and the actuating element, on the other hand, to be arranged on opposite sides of the holding part.

It is expedient for the actuating element to pass through the holding part with at least one section at at least one through-opening and to be connected to at least one locking element of the locking device, and for the at least one section to be movable in the at least one through-opening to transfer the actuating element from the unactuated position to the actuated position. The operator can act on the actuating element at a side of the holding part. With at least one section, the actuating element passes through the at least one through-opening in the holding part. The operator can thereby act on at least one locking element on the opposite side of the holding part. For this purpose, the at least one section is movable in the at least one through-opening. For example, the actuating element passes through the holding part with two sections at a respective through-opening.

The locking device is, for example, configured as latching device and/or as clamping device. Accordingly, locking elements of the locking device can be latching elements and/or clamping elements. The holding part can be connected to the carrying part by latching and/or clamping and locked to it.

The locking device preferably comprises at least one first locking element arranged on the holding part and at least one second locking element arranged on the carrying part, which interact in the locked position and by actuation of the actuating element are transferable to the unlocked position. In the unlocked position, the locking elements do not interact in order to be able to release the holding part from the carrying part. Accordingly, "locked position" and "unlocked position" relate, in the present case, to the locking device and its locking elements.

For implementation of the dirt pick-up device in practice, it is advantageous for the at least one first locking element and the at least one second locking element to comprise a projection and a stop element for the latter, the projection engaging behind the stop element in the locked position, and the rear engagement being released in the unlocked position. In the locked position, the projection and the stop element form corresponding stops, which are effective opposite to a direction of connection of the holding part with the carrying part and lock the holding part to the carrying part. In the unlocked position, the rear engagement of the projection is released and so the holding part can be released from the carrying part opposite to the direction of connection. The projection and/or the stop element are preferably interacting latching elements.

It is expedient for the at least one projection to comprise at least one slide-on surface for the stop element, along which the latter slides when connecting the holding part to the carrying part and/or releasing the holding part from the carrying part. The respective slide-on surface is aligned at an angle to a direction of connection or at an angle opposite to the direction of connection of the holding part with the carrying part. This enables the stop element to be transferred, as it were, "automatically" from the locked position to the unlocked position when the holding part is acted upon with a force opposite to the direction of connection to release it from the carrying part. Conversely, when connecting the holding part to the carrying part, the stop element can slide along a slide-on surface such that the projection enters into rear engagement with the stop element. The locking device can thereby be of self-unlocking and/or self-locking configuration.

The at least one projection is, for example, of lobe-shaped or peg-shaped configuration. In the last-mentioned advantageous embodiment, the at least one projection is, for example, of tapering configuration in the direction of its free end and has a respective slide-on surface for the stop element on opposite sides.

It is advantageous for the at least one first locking element to comprise or form the at least one stop element, and for the at least one second locking element to comprise or form the at least one projection.

The at least one projection may, for example, be formed in one piece with the carrying part or with the holding part. For example, the at least one projection is molded on the carrying part or on the holding part and preferably formed with it as cast part.

It proves expedient for the locking device to comprise two first locking elements and two second locking elements, the first locking elements and the second locking elements being arranged, in each case, at a distance from each other on the holding part and on the carrying part, respectively. A respective first locking element interacts with a respective second locking element, the interacting pairs being at a distance from each other. This enables reliable connection of the holding part to the carrying part. In addition, the holding part can be secured against rotation relative to the carrying part.

It is particularly advantageous for the at least one first locking element and the at least one second locking element to be pretensioned in the unlocked position relative to each other in the direction of the locked position. For this purpose, the dirt pick-up device preferably comprises a pretensioning device which acts upon at least one locking element in the unlocked position with a pretensioning force. For example, the at least one first locking element arranged on the holding part is acted upon with the pretensioning force. The pretensioning device is formed, for example, by the elastically deformable deformation element mentioned hereinbelow.

It is expedient for the locking device to have a locking space in which the locking elements are arranged in the connected state of the carrying part and the holding part, the locking space being delimited by walls formed by the carrying part and by the holding part. In the locking space the locking elements are protected against outside influences, in particular, dirt and humidity. The functioning of the locking device can thereby also be reliably maintained in the long term. The actuating element engages the locking space, for example, with at least one section which passes through at least one through-opening in the holding part so that the locking device can be acted upon.

The actuating element is preferably connected to at least one first locking element, in particular, it is expediently connected to it in one piece. The actuating element and the at least one first locking element are together, for example, of wire-shaped or rod-shaped configuration.

In order to achieve a constructionally simple configuration of the dirt pick-up device, it is advantageous for the at least one first locking element to comprise or form the actuating element or vice versa.

It is expedient for the dirt pick-up device to comprise a deformation element which comprises or forms the at least one first locking element and is supported on the holding part and/or on the suction strip, and for the at least one first locking element to be transferable from the locked position to the unlocked position with elastic deformation of the deformation element and to be transferable from the unlocked position to the locked position with return deformation. This enables a constructionally simple configuration of the dirt pick-up device in which the locking device can be unlocked and locked, respectively, by deformation of the deformation element. The deformation element may be the aforementioned pretensioning device for pretensioning the locking elements relative to each other.

It is advantageous for the deformation element to comprise or form the actuating element, the deformation element being elastically deformable by the application of force to the actuating element in order to transfer the latter from the unactuated position to the actuated position, and the actuating element being transferable from the actuated position to the unactuated position with return deformation of the deformation element. This also enables a constructionally simple configuration of the dirt pick-up device. By applying force to the actuating element, the deformation element is elastically deformed such that with its return deformation the actuating element is transferred from the actuated position to the unactuated position. The deformation element can thereby form the aforementioned pretensioning device for pretensioning the actuating element.

It proves expedient for the deformation element to be wire-shaped or rod-shaped. In particular, in the case of wire-shaped configuration, the deformation element is preferably a resilient bow which can be deformed by the application of force to the actuating element in order to unlock the locking device, the locking device being able to lock upon return deformation.

It proves advantageous for the deformation element to comprise two segments arranged at an angle to each other and connected to each other at an apex of the angle, with preferably sections thereof engaging a locking space of the locking device in which the locking elements are arranged, the segments being approachable towards each other and spreadable relative to each other with the angle thereby being reduced and increased, respectively. The segments can form legs of the angle, which are resiliently connected to each other by way of the apex of the angle. A first segment is supported, for example, on the holding part and/or on the suction strip. A second segment forms, for example, the at least one first locking element and the actuating element. By the application of force to the actuating element, the segments can be made to approach each other with the angle thereby being reduced. The segments are spread relative to each other by elastic return deformation.

Preferably two pairs of segments are provided, which are connected to each other at a respective apex.

The dirt pick-up device can comprise or form a lever, which is movable at a fulcrum. The lever is preferably a one-sided lever on which the at least one first locking element is arranged and at a greater distance from the fulcrum the actuating element. The lever is formed, for example, by one of the aforementioned segments of the deformation element, the apex of which is the fulcrum.

The actuating element can be movably mounted, for example, pivotably mounted on the holding part, on the carrying part or on the suction strip for transfer from the unactuated position to the actuated position.

The locking device is preferably self-locking and/or self-unlocking, the holding part and the carrying part being connectable to each other in a direction of connection and releasable from each other opposite to the direction of connection. When connecting the holding part to the carrying part, the locking device can automatically assume the locked position. Alternatively or additionally, when the suction strip is subjected to excessive force, for example, by contact with an obstacle, the locking device can automatically assume the unlocked position. The holding part is thereby released from the carrying part in order to avoid damage to the dirt pick-up device.

In an operating position of the dirt pick-up device, the direction of connection is expediently aligned along a cleaning direction of the floor cleaner. Upon contact of the suction strip with an obstacle, the holding part with the suction strip held thereon can disengage from the carrying part opposite to the cleaning direction.

It is expedient for the carrying part and the holding part to comprise at least one supporting projection and at least one receptacle, the at least one supporting projection engaging the at least one receptacle and being arranged in at least one direction in space transversely to the direction of the engagement with a positively locking connection in the at least one receptacle. A supporting force can be transmitted from the carrying part to the holding part and vice versa by way of the supporting projection and the receptacle. In particular, this allows the supporting of the holding part on the carrying part to be functionally separated from the locking of the holding part on the carrying part. This makes it possible to use components of rather small dimensions for the locking device and the actuating element, which can be easily actuated by an operator by applying little force.

The direction of the engagement is preferably aligned along a cleaning direction of the floor cleaner, in relation to an operating position of the dirt pick-up device.

It proves advantageous for the at least one supporting projection to be arranged in two directions in space aligned transversely to the direction of the engagement with a positively locking connection in the at least one receptacle.

It may be provided that the at least one supporting projection is arranged on the holding part, and that the at least one receptacle is arranged on the carrying part.

The at least one supporting projection is preferably formed in one piece with the holding part and is, for example, molded on it. For example, the holding part is formed with the supporting projection as plastic molded part.

It is expedient for the at least one supporting projection to be of tapering configuration in the direction of its free end. For example, the at least one supporting projection has a conical shape, for example, the shape of a cone, a truncated cone, a pyramid or a truncated pyramid. The tapering supporting projection can be introduced more easily into the receptacle and the handling of the dirt pick-up device thereby facilitated.

In an implementation of the dirt pick-up device in practice, it is expedient for two supporting projections and receptacles associated, in each case, with these to be provided, the supporting projections and the receptacles being arranged, in each case, at a distance from each other, and for a locking space and locking elements of the locking device arranged therein to preferably be positioned between the supporting projections and the receptacles.

As mentioned at the outset, the present invention also relates to a floor cleaner. The object set at the outset is accomplished, in accordance with the invention, by a floor cleaner with at least one dirt pick-up device of the aforementioned kind. The floor cleaner is, for example, a scrubbing-suction machine.

The advantages already mentioned in connection with the explanation of the dirt pick-up device in accordance with the invention can also be achieved with the floor cleaner in accordance with the invention. With regard to this, reference is made to the above statements.

FIG. 1 shows in a side view an advantageous embodiment, denoted by reference numeral 10, of a floor cleaner in accordance with the invention, configured as a scrubbing-suction machine. On an underside, the floor cleaner 10 has a cleaning unit 12, in the present case, a disk brush. The cleaning unit 12 can be lowered onto a floor surface 14 to be cleaned. Dirt can be detached from the floor surface 14 under the action of the cleaning unit 12. As a supportive measure, the floor surface 14 is acted upon with a cleaning liquid, for example, water. The cleaning liquid is stored in a liquid tank, not shown in the drawings, of the floor cleaner 10.

Also not shown in the drawings are a suction unit and a dirty liquid tank of the floor cleaner 10. The suction unit allows a suction pipe 16, in the present case, a suction hose, to be acted upon with negative pressure.

The floor cleaner 10 further comprises an advantageous embodiment of a dirt pick-up device 18 in accordance with the invention. The mixture of detached dirt and cleaning liquid can be picked up from the floor surface 14 with the dirt pick-up device 18 and under the action of the suction unit transferred to the dirty liquid tank.

The dirt pick-up device 18 is releasably fixed to the underside of the floor cleaner 10. It could, however, also be fixedly connected to the floor cleaner 10. For fixing to the floor cleaner 10, the dirt pick-up device 18 comprises a carrying part 22. The carrying part 22 has a coupling element 24 for interaction with a corresponding coupling element of the floor cleaner 10. In the present case, the coupling element 24 is a spherical coupling head, and the corresponding coupling element is a preferably hemispherical ball cup. A securing member secures the ball head in the ball cup (not shown).

The dirt pick-up device 18 further comprises a holding part 26, which is releasably connectable to the carrying part 22, and a suction strip 28. The suction strip 28 is held, for example, by screw connection on the holding part 26. When the dirt pick-up device 18 is used in accordance with the specifications, the suction strip 28 is aligned, in particular, transversely to a longitudinal direction 30 of the floor cleaner 10 when it is moved straight ahead in a straight line. The longitudinal direction 30 defines a cleaning direction of the floor cleaner 10 and the dirt pick-up device 18. The dirt pick-up device 18 is pivotable, in the present case, relative to the floor cleaner 10 by way of the interacting coupling elements.

Figure 6:
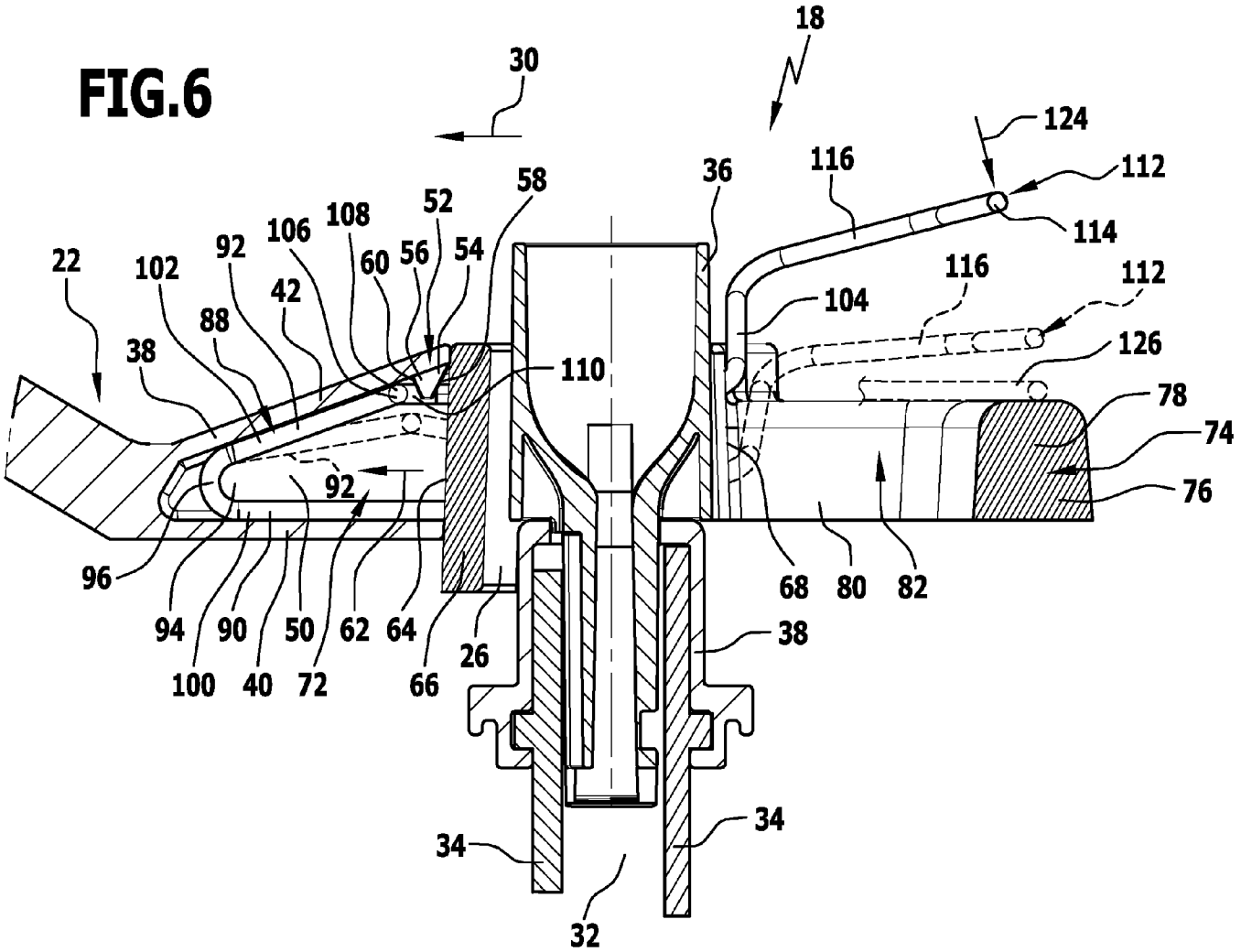
FIG. 6 shows a (partial) sectional view along line 6-6 in FIG. 4.

The suction strip 28 defines a suction channel 32 which is delimited, in a manner known per se, at the front and rear in the cleaning direction 30 by wiper elements 34. A connection element 36, to which the suction pipe 16 is connected, opens into the suction channel 32 (FIG. 6).

FIG. 1 shows the dirt pick-up device 18 in a position in which it is lifted off the floor surface. During use in accordance with the specifications, the dirt pick-up device 18 is lowered such that the suction strip 28 contacts the floor surface 14 by way of the wiper elements 34, thereby enabling dirty liquid to be sucked into the suction pipe 16 through the suction channel 32.

Figure 2:
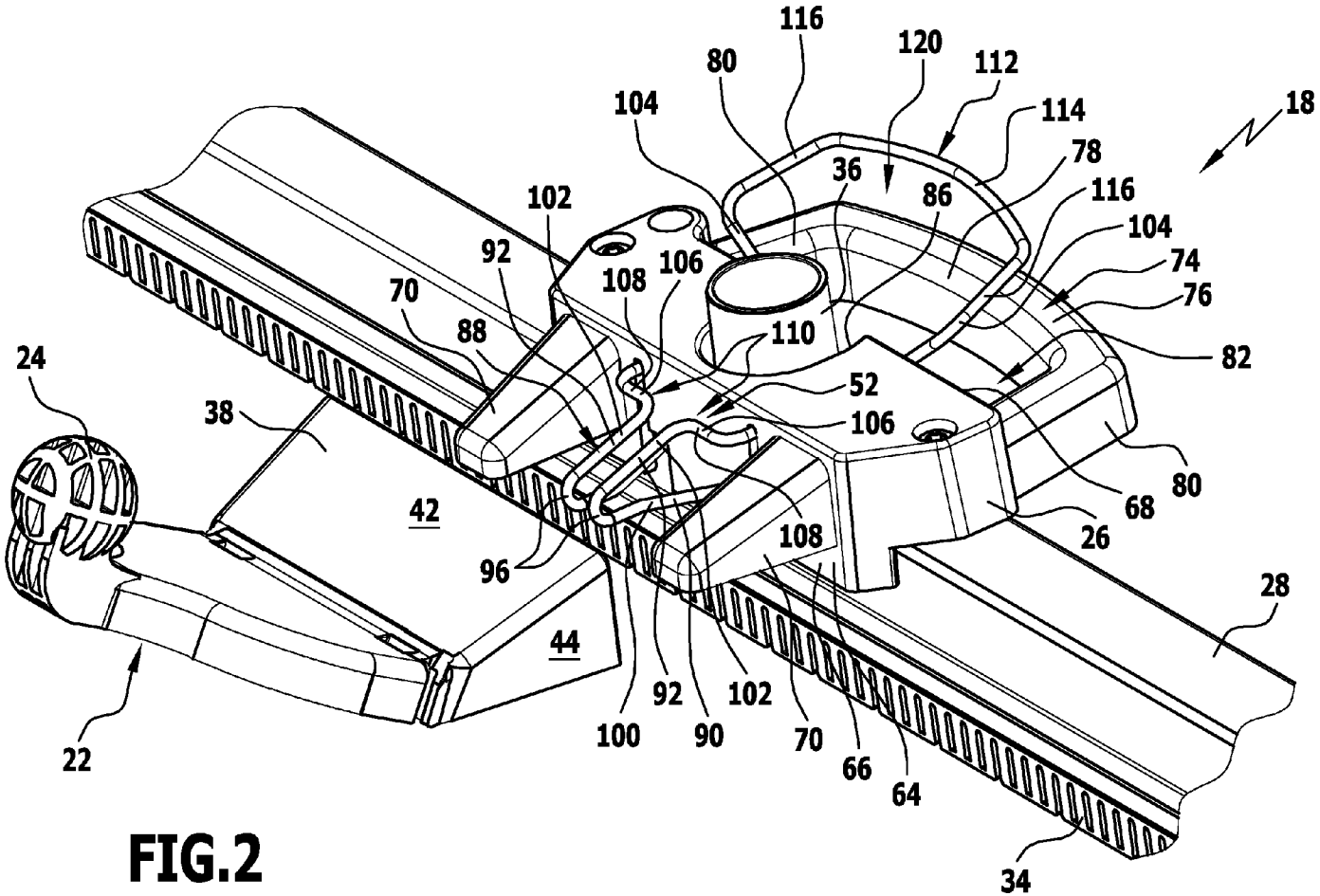
FIG. 2 shows a perspective partial illustration of the dirt pick-up device from FIG. 1, comprising a carrying part and a holding part with a suction strip held thereon.
Figure 3:
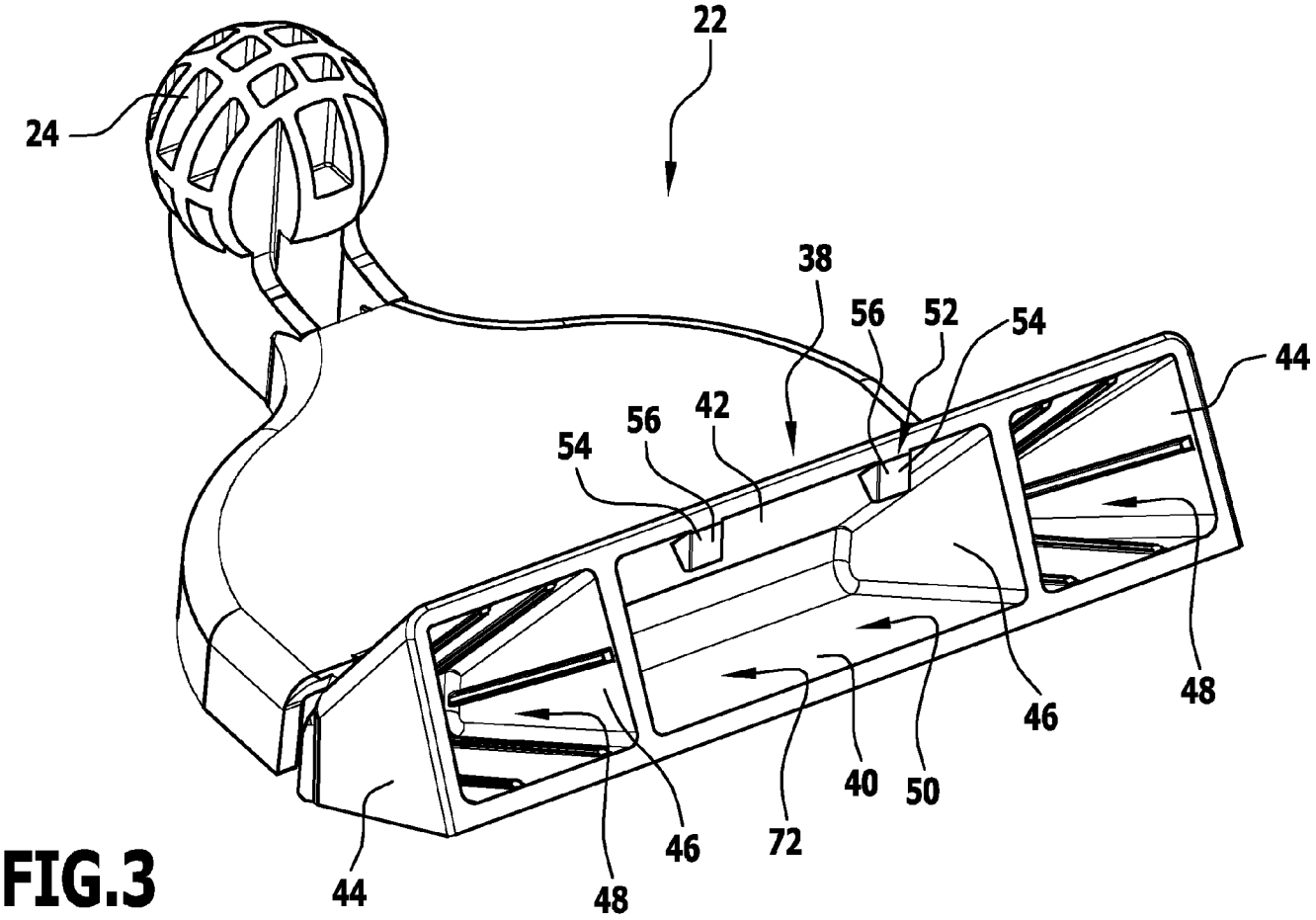
FIG. 3 shows a perspective illustration of the carrying part of the dirt pick-up device.

As is clear, in particular, from FIGS. 2 and 3, the carrying part 22 comprises a receiving section 38 by way of which the carrying part 22 can be connected to the holding part 26. The receiving section 38 has a lower wall 40, an upper wall 42, side walls 44 and intermediate walls 46. The walls 40, 42, 44 and 46 define three receptacles of the receiving section 38. Two receptacles 48 of these are delimited by a respective side wall 44, a respective intermediate wall 46 and a respective section of the lower wall 40 and the upper wall 42, respectively. The receptacles 48 are spaced from each other, and a receptacle 50 is arranged between them. The receptacle 50 is delimited by the intermediate walls 46 and respective sections of the lower wall 40 and the upper wall 42.

The receptacles 48 taper conically, with their cross sections decreasing from an insertion opening. Projection elements, in the present case, in the form of ribs, may be arranged on the walls 40 to 46 delimiting the receptacles 48. The projection elements allow compensation of possible manufacturing tolerances in the manufacture of the carrying part 22 and/or the holding part 26.

The receptacle 50 also tapers conically, with its cross section decreasing from an insertion opening.

In order to lock the holding part 26 in the state in which it is connected to the carrying part 22 (this will be explained hereinbelow), the dirt pick-up device 18 comprises a locking device 52. The locking device 52 comprises locking elements 54 which are arranged on the carrying part 22. In the present case, two locking elements 54 are provided in the form of projections 56. The projections 56 are arranged on the upper wall 42 of the carrying part 22 and are preferably connected in one piece thereto. For example, the projections 56 are molded on the upper wall 42.

The projections 56 are positioned next to the insertion opening of the receptacle 50 on the carrying part 22, but they could also be positioned elsewhere in the receptacle 50.

The projections 56 are identically formed and spaced from each other.

As is clear, in particular, from FIG. 6, each projection 56 has a first slide-on surface 58. A normal of the slide-on surface 58 faces out of the receptacle 50. Each projection 56 also has a second slide-on surface 60. The normal of the slide-on surface 60 faces into the receptacle 50. The slide-on surfaces 58, 60 are aligned at an angle to a direction of connection 62 in which locking elements on the holding part 26 which interact with the projections 56 can be inserted into the receptacle 50. The projections 56 have an overall shape which tapers in the direction of their free ends.

The holding part 26 has a front side 64 which faces the carrying part 22 and at which a front wall 66 facing the carrying part 22 is arranged. The holding part 26 has a rear side 68 facing away from the carrying part 22.

Position and orientation details such as, for example, "at the front", "at the rear", "at the top" and "at the bottom" are, in the present case, to be understood as relating to use of the dirt pick-up device 18 in accordance with the specifications. During this, the dirt pick-up device 18 contacts the floor surface 14 with the suction strip 28, and the direction of connection 62 extends along the cleaning direction 30.

The holding part 26 comprises supporting projections 70 for insertion into the receptacles 48. Two supporting projections 70 are provided, which are spaced from each other and project from the front wall 66 in the direction of the carrying part 22. The supporting projections 70 are designed so as to taper in the direction of their free ends. Overall, the supporting projections 70 have approximately the shape of a truncated pyramid.

When the holding part 26 is connected to the carrying part 22, the supporting projections 70 are inserted along the direction of connection 62 into the receptacles 48. The supporting projections 70 are of such dimensions that they are arranged in a plane transversely to the direction of connection 62 with a positively locking connection in the respective receptacle 48. Along two directions in space aligned transversely to each other, each supporting projection 70 can thereby be supported transversely to the direction of connection 62 at the walls of the respective receptacle 48. Forces from the carrying part 22 onto the holding part 26 and vice versa can thereby be effectively directed away via the receptacles 48 and the supporting projections 70.

The holding part 26 can be brought up close to the carrying part 22 until the front wall 66 contacts end faces of the walls 40 to 46. The front wall 66 can thus form a wall closing the receptacle 50. The receptacle 50 thereby defines a substantially closed locking space 72. The projections 56 are arranged in the locking space 72.

The dirt pick-up device 18 further comprises a grip element 74 arranged on the holding part 26. The grip element 74 is held on the rear side 68 and is preferably formed in one piece with the holding part 26. For example, the holding part 26 together with the grip element 74 and preferably the supporting projections 70 is a one-piece plastic molded part.

In the present case, the grip element 74 is configured as a bow-shaped handle 76. The bow-shaped handle 76 is C-shaped and has a grip section 78 at a distance from the rear side 68 and legs 80 extending from the grip section 78 in the direction of the rear side 68. The bow-shaped handle 76 defines a reach-through area 82 for an operator between the grip section 78 and the rear side 68.

The bow-shaped handle 76 is aligned such that a normal of the reach-through area 82 is aligned in height direction, for example, vertically. An operator can thereby grasp the bow-shaped handle 76 preferably from above at the grip section 78, with his fingers reaching through the reach through-area 82.

The holding part 26 has two through-openings 84 extending from the rear side 68 to the front side 64. At the front wall 66, the through-openings 84 are arranged between the supporting projections 70, and at the rear side 68 between the legs 80. The through-openings 84 are slot-shaped or slit-shaped.

The holding part 26 forms a recess 86 between the through-openings 84. The connection element 36 passes through the recess 86.

The dirt pick-up device 18 comprises a deformation element 88. The deformation element 88 is elastically deformable by the application of force and serves to provide and release the locking of the holding part 26 to the carrying part 22. In the present case, the deformation element 88 is wire-shaped and forms an elastically resilient bow, in order to achieve a constructionally simple design and easy handling of the dirt pick-up device 18. The deformation element 88 has two first segments 90 and two second segments 92, which are legs of a respective angle 94 and are connected to each other at a respective apex 96.

Figure 5:
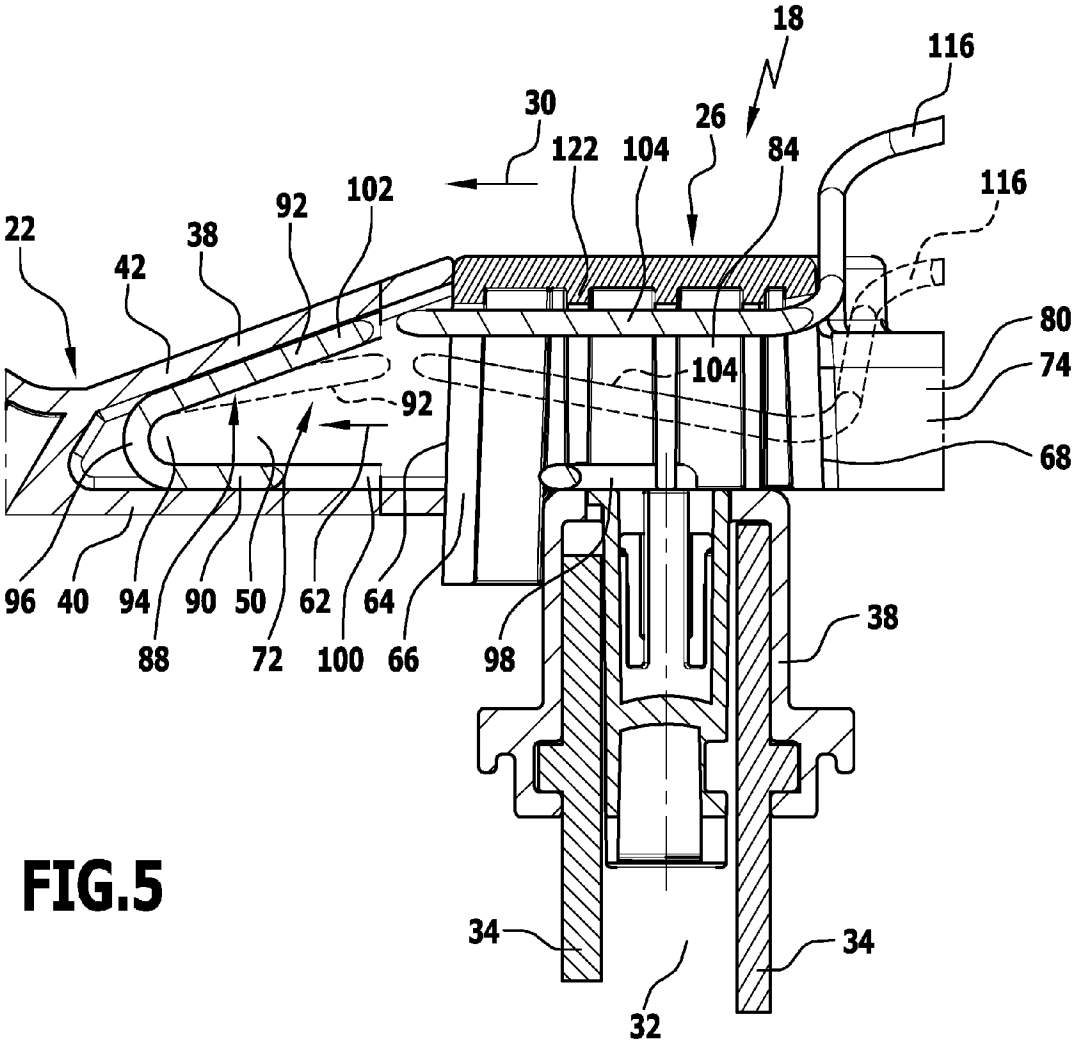
FIG. 5 shows a (partial) sectional view along line 5-5 in FIG. 4.

The segments 90 have respective first sections 98 and second sections 100. The first sections 98 (FIG. 5) are arranged in a respective through-opening 84 and firmly connected to the holding part 26 and/or the suction strip 28 so that they can be supported on the holding part 26 and/or on the suction strip 28. The respective second section 100 is arranged between the supporting projections 70 in front of the front wall 66 (FIGS. 2, 5 and 6). The second sections 100 border on the apexes 96.

The second segments 92 each have a first section 102 which borders on a respective apex 96 and is arranged between the supporting projections 70 in front of the front wall 66. The second segments 92 also have a respective second section 104 adjoining the first section 102.

The first section has a bending at its end facing away from the apex 96. The first section 102 is bent twice at the bending, first outwards away from the respective other segment 92 and then in the direction of the front wall 66, so that an approximately parallel offset is formed by the bending in the section 102.

The respective section 102 forms a locking element 108 of the locking device 52 for interaction with the projection 56. The respective bending forms, in particular, a stop element 106 for the projection, which is effective opposite to the direction of connection 62. A respective undercut 110 in which the projection 56 can engage is formed on the stop element 106 between the section 102 and the front wall 66.

The respective second sections 104 adjoin the first sections 102 in an extension thereof and pass through the respective through-opening 84 above the sections 98 of the first segments 90. The second sections exit at the rear side 68 from the through-openings 84. The second sections 104 extend along the rear side 68 outwards and are then bent. Here they face away from the rear side 68 and in a plan view (FIG. 4) extend approximately parallel to the legs 80. Both sections 104 are then bent inwards and in a plan view extend approximately parallel to the grip section 78 above which they are connected to each other.

The deformation element 88 thereby forms by way of the sections 104 an actuating element 112 for actuating the locking device 52. The actuating element 112 is of bow-shaped configuration with a grip section 114 above the grip section 78, formed by the sections 104 connected to each other. Projecting away from the grip section 114 are legs 116 of the actuating element 112, formed by the sections 104 above the legs 80, parallel to the rear side 68 and through the through-openings 84. The sections 104 are movable in the through-openings in the direction towards the segments 90.

Figure 4:
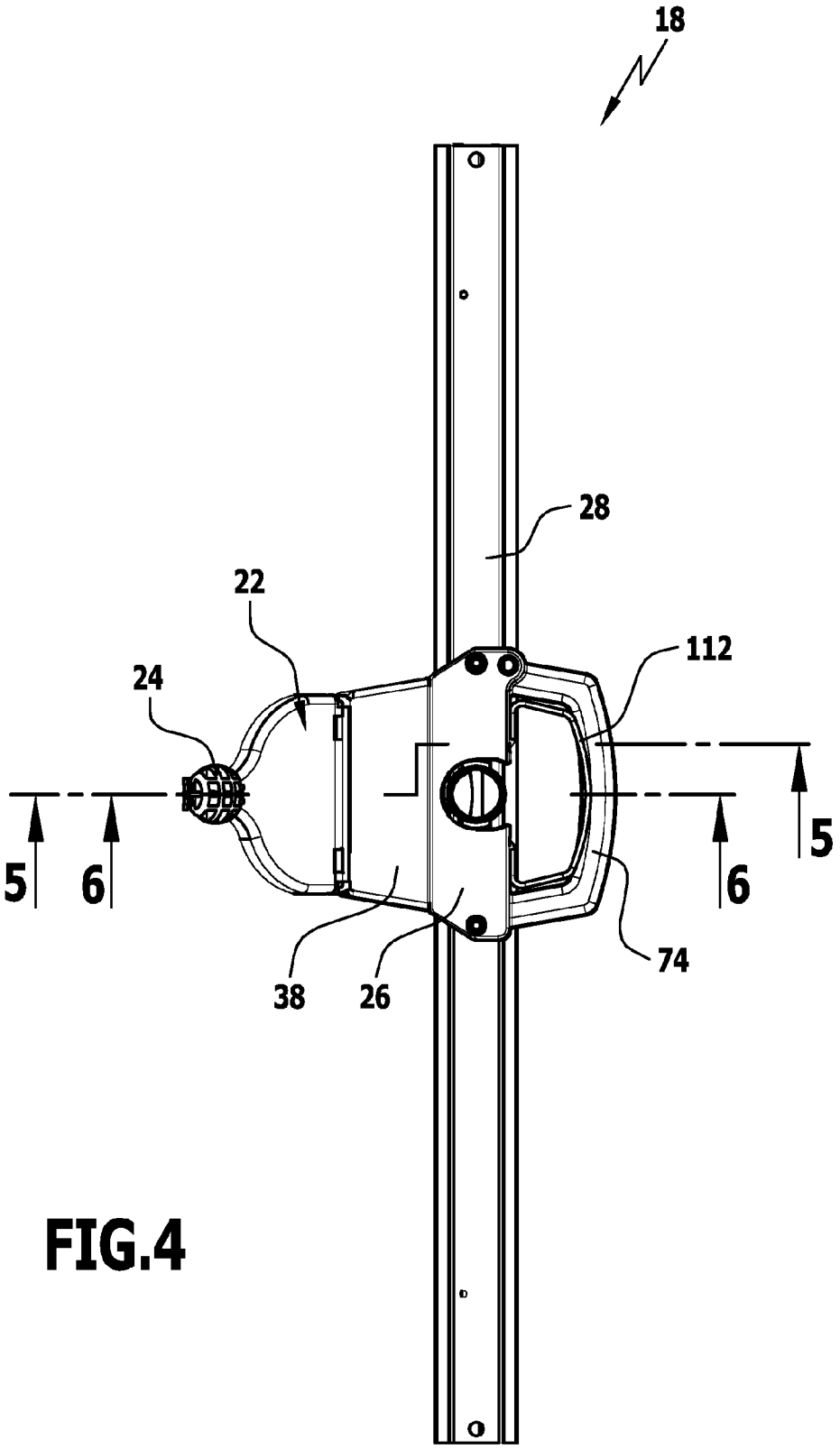
FIG. 4 shows a plan view of the dirt pick-up device from FIG. 1.

The actuating element 112 thereby has in a plan view an approximately C-shaped configuration in a section thereof and is adapted in its contour to the contour of the bow-shaped handle 76 (FIG. 4). The actuating element 112 defines a reach-through area 120. An operator can reach through the reach-through area 120 with his hand in order to grasp, as explained hereinabove, the bow-shaped handle 76 through the reach-through area 82.

Owing to the one-piece configuration of the deformation element 88, the actuating element 112 is connected in one piece to the locking elements 108.

The mode of operation of the locking device 52 and the actuating element 112 will be explained hereinbelow with reference, in particular, to FIGS. 2, 5 and 6.

In the state in which the carrying part 22 and the holding part 26 are connected to each other, the supporting projections 70 engage, as mentioned hereinabove, the receptacles 48 with a positively locking connection. The respective sections 100 and 102 of the segments 90, 92 engage the receptacle 50. The sections 100 can lie against the lower wall 40, and the sections 102 contact at their side facing the apex 96 the upper wall 42. In the locking space 72, the locking elements 54 are in latching engagement with the locking elements 108, with the projections 56 engaging behind the stop elements 106 at the undercut 110 (FIG. 6).

This defines a locked position of the locking device 52. In the locked position, the holding part 26 is locked to the carrying part 22 and blocked in its movement opposite to the direction of connection 62. During use of the dirt pick-up device 18 in accordance with the specifications, the locking device 52 assumes the locked position. Carrying forces between the carrying part 22 and the holding part 26 are substantially directed away via the receptacles 48 and the supporting projections 70.

In the locked position of the locking device 52, the deformation element 88 is shaped such that the second sections 104 lie at an underside against an upper wall 122. The upper wall 122 delimits the through-openings 84 at the upper side (FIG. 5).

The actuating element 112 assumes an unactuated position when the locking device 52 assumes the locked position. In the unactuated position, the actuating element 112 is at a distance from the bow-shaped handle 76. In particular, the grip sections 78 and 114 are at a distance from each other (FIG. 6).

If the holding part 26 is to be released from the carrying part 22, the locking device 52 has to be unlocked. For this purpose, the operator can act upon the actuating element 112 with a force directed at the bow-shaped handle 76, which is symbolized by an arrow 124 in FIG. 6. When doing so, the operator can reach through the reach-through area 120.

The deformation element 88 is elastically deformed when force is applied to the grip section 114. In particular, the respective segments 90 and 92 approach each other, and the angle 94 formed between them is thereby reduced. The segments 90, 92 are pivoted relative to each other at the respective apex 96, with the sections 104 being able to move in the through-openings 84.

The actuating element 112 can be transferred from the unactuated position to an actuated position by the application of force. In the actuated position, the distance of the actuating element 112 from the bow-shaped handle 76 is less than in the unactuated position, in particular, the distance of the grip sections 78 and 114 from each other. The position of the segments 92 and, in particular, of the actuating element 112 in the actuated position is symbolized by dashed lines in FIGS. 5 and 6.

The locking device 52 can be transferred to the unlocked position by transferring the actuating element 112 to the actuated position. The sections 102 are brought up closer to the sections 100 until the rear engagement of the projections 56 with the stop elements 106 is released. It is thereby possible to release the holding part 26 opposite to the direction of connection 62 from the carrying part 22 (shown in dashed lines in FIG. 6).

Particularly easy handling is found to be enabled by the actuating element 112 being brought up closer to the bow-shaped handle 76 by transfer to the actuated position. With one-hand operation, the operator can first actuate the actuating element 112, thereby unlocking the locking device 52, and grasp the bow-shaped handle 76 with the same movement. The holding part 26 with the suction strip 28 held thereon can thereby be released in a simple and user-friendly way from the carrying part 22.

The actuating element 112 can be transferred to the actuated position to such an extent that it lies against the bow-shaped handle 76, symbolized by a contour 126 (in FIG. 6). Owing to the adaptation of the contour of the actuating element 112 to the contour of the bow-shaped handle 76, the actuating element 112 is not experienced as disturbing when carrying the holding part 26.

The deformation element 88 forms a pretensioning device. The pretensioning device pretensions the locking elements 54 and 108 in the unlocked position in the direction of the locked position. The pretensioning device also pretensions the actuating element 112 in the actuated position in the direction of the unactuated position. Absence of the force 124 of the user on the actuating element 112 results in the deformation element 88 undergoing elastic return deformation. The segments 90, 92 then spread relative to each other and the angle 94 is thereby increased. The engagement of the projections 56 in the undercuts 110 is established again, and the distance of the actuating element 112 from the bow-shaped handle 76 is increased until the sections 104 contact the upper wall 122.

Owing to the pretensioning, it is, for example, possible for the holding part 26 to be prevented from becoming unintentionally released from the carrying part 22 when the actuating element 112 is inadvertently acted upon by the force 124, but the holding part 26 is not released from the carrying part 22 opposite to the direction of connection 62. The pretensioning ensures that the locking device 52 automatically assumes the locked position again.

Furthermore, the locking device 52 is self-unlocking, in order to prevent damage to the dirt pick-up device 18 in the event of collision with an obstacle. When the suction strip 28 contacts an obstacle, this can cause a force to act on the holding part 26 opposite to the direction of connection 62. The stop elements 106 contact the slide-on surfaces 60 of the projections 56. Upon further application of force, the deformation element 88 undergoes deformation, with the stop elements 106 sliding along the slide-on surfaces 60. The locking device 52 is transferred to the unlocked position, and the rear engagement of the projections 56 with the stop elements 106 is released. The holding part 26 is thereby released from the carrying part 22.

Here it is particularly advantageous that the direction of connection 62 extends in the longitudinal direction or cleaning direction 30. If the suction strip 28 gets caught during the cleaning operation, it is released opposite to the cleaning direction 30 rearwards from the floor cleaner 10.

In a similar way, the locking device 52 is self-locking, which makes it easier for an operator to connect the holding part 26 to the carrying part 22. When inserting the sections 100, 102 into the receptacle 50 along the direction of connection 62, the stop elements 106 can contact the slide-on surfaces 58 of the projections 56. The deformation element 88 can be deformed by the application of force, and the stop elements 106 slide along the slide-on surfaces 58 until the projections 56 can engage behind the stop elements 106. The locking device 52 thereby automatically assumes the locked position, with the deformation element 88 undergoing return deformation, and the holding part 26 is locked to the carrying part 22.

The invention claimed is:

1. A dirt pick-up device for a floor cleaner, comprising a carrying part fixed or fixable to the floor cleaner and a holding part releasably connectable to the carrying part with a suction strip held on the holding part, the carrying part and the holding part being locked to each other by a locking device assuming a locked position, the dirt pick-up device comprising an actuating element which is transferable from an unactuated position to an actuated position for transferring the locking device to an unlocked position in which the holding part is releasable from the carrying part, wherein the dirt pick-up device comprises or forms a grip element held on at least one of the holding part and the suction strip, and wherein in the unactuated position the actuating element is at a greater distance from the grip element than in the actuated position in which an operator is able to grasp the grip element.

2. The dirt pick-up device in accordance with claim 1, wherein the grip element is configured as bow-shaped handle, handle bar, grip edge, olive handle, knob grip, grip eyelet or recessed grip.

3. The dirt pick-up device in accordance with claim 1, wherein the grip element is formed in one piece with the holding part.

4. The dirt pick-up device in accordance with claim 1, wherein the actuating element is of bow-shaped configuration.

5. The dirt pick-up device in accordance with claim 1, wherein the actuating element has a contour identical or similar to the contour of the grip element and in the actuated position is positionable against the grip element.

6. The dirt pick-up device in accordance with claim 1, wherein at least one of the grip element and the actuating element define a reach-through area for an operator to reach through.

7. The dirt pick-up device in accordance with claim 1, wherein in an operating position of the dirt pick-up device, the actuating element is arranged above the grip element.

8. The dirt pick-up device in accordance with claim 1, wherein the actuating element is pretensioned in the actuated position in the direction of the unactuated position.

9. The dirt pick-up device in accordance with claim 1, wherein the locking device, on the one hand, and the grip element and the actuating element, on the other hand, are arranged on opposite sides of the holding part.

10. The dirt pick-up device in accordance with claim 1, wherein the actuating element passes through the holding part with at least one section at at least one through-opening and is connected to at least one locking element of the locking device, and wherein the at least one section is movable in the at least one through-opening to transfer the actuating element from the unactuated position to the actuated position and vice versa.

11. The dirt pick-up device in accordance with claim 1, wherein the locking device is configured as at least one of a latching device and a clamping device.

12. The dirt pick-up device in accordance with claim 1, wherein the locking device comprises at least one first locking element arranged on the holding part and comprises at least one second locking element arranged on the carrying part, which interact in the locked position and by actuation of the actuating element are transferable to the unlocked position.

13. The dirt pick-up device in accordance with claim 12, wherein the at least one first locking element and the at least one second locking element comprise a projection and a stop element for the latter, the projection engaging behind the stop element in the locked position to form a rear engagement of the projection with the stop element, with the rear engagement being released in the unlocked position.

14. The dirt pick-up device in accordance with claim 13, wherein the at least one projection comprises at least one slide-on surface for the stop element, along which the latter slides when connecting the holding part to the carrying part and/or releasing the holding part from the carrying part.

15. The dirt pick-up device in accordance with claim 13, wherein the at least one first locking element comprises or forms the at least one stop element, and wherein the at least one second locking element comprises or forms the at least one projection.

16. The dirt pick-up device in accordance with claim 13, wherein the at least one projection is formed in one piece with the carrying part or with the holding part.

17. The dirt pick-up device in accordance with claim 12, wherein the locking device comprises two first locking elements and two second locking elements, the first locking elements and the second locking elements being arranged, in each case, at a distance from each other on the holding part and on the carrying part, respectively.

18. The dirt pick-up device in accordance with claim 12, wherein the at least one first locking element and the at least one second locking element are pretensioned in the unlocked position relative to each other in the direction of the locked position.

19. The dirt pick-up device in accordance with claim 12, wherein the locking device has a locking space in which the locking elements are arranged in the connected state of the carrying part and the holding part, the locking space being delimited by walls formed by the carrying part and by the holding part.

20. The dirt pick-up device in accordance with claim 12, wherein the actuating element is connected in one piece to at least one first locking element.

21. The dirt pick-up device in accordance with claim 12, wherein the at least one first locking element comprises or forms the actuating element or vice versa.

22. The dirt pick-up device in accordance with claim 12, wherein the dirt pick-up device comprises a deformation element which comprises or forms the at least one first locking element and is supported on at least one of the holding part and the suction strip, and wherein the at least one first locking element is transferable from the locked position to the unlocked position with elastic deformation of the deformation element and is transferable from the unlocked position to the locked position with return deformation.

23. The dirt pick-up device in accordance with claim 22, wherein the deformation element comprises or forms the actuating element, the deformation element being elastically deformable by the application of force to the actuating element in order to transfer the latter from the unactuated position to the actuated position, and the actuating element being transferable from the actuated position to the unactuated position with return deformation of the deformation element.

24. The dirt pick-up device in accordance with claim 22, wherein the deformation element is a wire or a rod.

25. The dirt pick-up device in accordance with claim 22, wherein the deformation element comprises two segments arranged at an angle to each other and connected to each other at an apex of the angle, with sections thereof engaging a locking space of the locking device in which the locking elements are arranged, the segments being approachable towards each other and spreadable relative to each other with the angle thereby being reduced and increased, respectively.

26. The dirt pick-up device in accordance with claim 1, wherein the locking device is at least one of self-locking and self-unlocking, the holding part and the carrying part being connectable to each other in a direction of connection and releasable from each other opposite to the direction of connection.

27. The dirt pick-up device in accordance with claim 26, wherein, in an operating position of the dirt pick-up device, the direction of connection is aligned along a cleaning direction of the floor cleaner.

28. The dirt pick-up device in accordance with claim 1, wherein the carrying part and the holding part comprise at least one supporting projection and at least one receptacle, the at least one supporting projection engaging the at least one receptacle and being arranged in at least one direction in space transversely to the direction of the engagement with a positively locking connection in the at least one receptacle.

29. The dirt pick-up device in accordance with claim 28, wherein the direction of the engagement is aligned along an operating position of the dirt pick-up device in a cleaning direction of the floor cleaner.

30. The dirt pick-up device in accordance with claim 28, wherein the at least one supporting projection is arranged in two directions in space aligned transversely to the direction of the engagement with a positively locking connection in the at least one receptacle.

31. The dirt pick-up device in accordance with claim 28, wherein the at least one supporting projection is arranged on the holding part, and wherein the at least one receptacle is arranged on the carrying part.

32. The dirt pick-up device in accordance with claim 28, wherein the at least one supporting projection is formed in one piece with the holding part.

33. The dirt pick-up device in accordance with claim 28, wherein the at least one supporting projection is of tapering configuration in the direction of its free end.

34. The dirt pick-up device in accordance with claim 28, wherein two supporting projections and receptacles associated, in each case, with these are provided, the supporting projections and the receptacles being arranged, in each case, at a distance from each other, and wherein a locking space and locking elements of the locking device positioned therein are arranged between the supporting projections and the receptacles.

35. A floor cleaner, comprising at least one dirt pick-up device, the dirt pick-up device comprising a carrying part fixed or fixable to the floor cleaner and a holding part releasably connectable to the carrying part with a suction strip held on the holding part, the carrying part and the holding part being locked to each other by a locking device assuming a locked position, the dirt pick-up device comprising an actuating element which is transferable from an unactuated position to an actuated position for transferring the locking device to an unlocked position in which the holding part is releasable from the carrying part, wherein the dirt pick-up device comprises or forms a grip element held on at least one of the holding part and the suction strip, and wherein in the unactuated position the actuating element is at a greater distance from the grip element than in the actuated position in which an operator is able to grasp the grip element.

* * * * *